US008973802B2

(12) United States Patent
Fischer et al.

(10) Patent No.: US 8,973,802 B2
(45) Date of Patent: Mar. 10, 2015

(54) WIRE-PROCESSING MACHINE WITH LENGTH-COMPENSATING UNIT

(75) Inventors: Daniel Fischer, Lucerne (CH); Stefan Viviroli, Horw (CH); Benno Hafliger, Lucerne (CH)

(73) Assignee: Komax Holding AG, Dierikon (CH)

( * ) Notice: Subject to any disclaimer, the term of this patent is extended or adjusted under 35 U.S.C. 154(b) by 730 days.

(21) Appl. No.: 13/185,020

(22) Filed: Jul. 18, 2011

(65) Prior Publication Data

US 2012/0017732 A1 Jan. 26, 2012

(30) Foreign Application Priority Data

Jul. 20, 2010 (EP) ..... 10170192

(51) Int. Cl.

| | |
|---|---|
| ***B65H 51/00*** | (2006.01) |
| ***B65H 57/12*** | (2006.01) |
| ***B65H 51/14*** | (2006.01) |
| ***B65H 57/28*** | (2006.01) |

(52) U.S. Cl.

CPC ..... *B65H 57/12* (2013.01); *B65H 51/14* (2013.01); *B65H 57/28* (2013.01); *B65H 2701/34* (2013.01)

USPC ..... 226/24; 226/137

(58) Field of Classification Search

USPC ..... 29/564.4; 226/24, 36, 137, 141

See application file for complete search history.

(56) References Cited

U.S. PATENT DOCUMENTS

| | | | | |
|---|---|---|---|---|
| 4,663,822 | A | 5/1987 | Blaha et al. | |
| 5,025,549 | A | 6/1991 | Hornung et al. | |
| 6,363,604 | B1 * | 4/2002 | Sakuma | 29/566.1 |
| 2001/0025870 | A1 | 10/2001 | Hasegawa | |
| 2004/0144827 | A1 * | 7/2004 | Fox | 226/151 |

FOREIGN PATENT DOCUMENTS

| | | | |
|---|---|---|---|
| EP | 1548903 | A1 | 6/2005 |
| EP | 1956691 | A2 * | 8/2008 |
| EP | 1993175 | A2 * | 11/2008 |
| FR | 2691016 | A1 | 11/1993 |

* cited by examiner

*Primary Examiner* — Stephen Choi

(74) *Attorney, Agent, or Firm* — Fraser Clemens Martin & Miller LLC; William J. Clemens

(57) ABSTRACT

A wire-processing machine or apparatus includes a wire-feeding apparatus for guiding a wire, wherein the wire-processing machine or apparatus contains a wire drive for forward movement of the wire and a guide pipe with an entry opening and an exit opening. The wire-processing machine or apparatus contains a swivel unit with drive and a wire-gripping apparatus which is arranged on a swivel arm, wherein an exit side end of the guide pipe is fastened to the swivel arm. The wire drive and the guide pipe are arranged in such manner that the wire can be shot-in through the guide pipe. The wire-feed apparatus further contains a length-compensating unit which is arranged in the area of the guide pipe and which, in a first state, shortens an effective length of the guide pipe and, in a second state, lengthens the effective length of the guide pipe.

9 Claims, 5 Drawing Sheets

WIRE-PROCESSING MACHINE WITH LENGTH-COMPENSATING UNIT

CROSS-REFERENCE TO RELATED APPLICATION

This application claims priority to European Patent Application No. 10170192.8, filed Jul. 20, 2010, which is incorporated herein by reference.

FIELD

The disclosure relates to a wire-processing machine.

BACKGROUND

Typically in a wire-processing machine 1, as shown in FIGS. 1A and 1B by reference to an example, the wire K is transported by means of a wire-drive 3 (e.g. in the form of a belt-drive) from a reel, or from a wire-drum, to a cutting unit 4 of the wire-processing machine 1.

The wire-processing machine 1 can approach the individual processing modules 5, 6 by moving two swivel-units 7, 8. Such wire-processing machines 1 have the wire-drive 3 that is arranged before the first swivel-unit 7 and ideally a wire-gripper that is arranged at the end of the swivel-units 7, 8. So that the wire K cannot deviate during transport, and so that, therefore, when cutting the wire K, an exact length results, the wire K is guided between the wire-drive 3 and a gripper 7.1 of a first swivel-unit 7 in a flexible guide-tube 11. As can be seen in FIG. 1B, usually arranged on the first swivel-unit 7 after the gripper 7.1 is a guide-tube 10 which is exactly adapted to the wire diameter. This guide-tube 10 allows the wire-overhang, in other words the length of the free, unguided wire-end, to be kept as short as possible and the droop of the wire-end to be minimized.

Furthermore, such a wire-processing machine 1 typically contains an exit-side conveyor-belt 12 and, for example, a wire-deposit as shown in FIG. 1A.

Before cutting, or any other processing step, the wire K is grasped by the gripper 7.1 of the swivel-unit 7. Then, in the cutting unit 4, the leading wire-end is separated and, after cutting-in, stripped of insulation by means of a backwards-directed lengthwise movement of the gripper 7.1, to be then brought, for example with the swivel-unit 7, to a processing unit 5. The leading wire-end can then be, for example, fitted with a seal and a crimp-contact. When fitting of the leading wire-end is complete, the gripper 7.1 is opened and the swivel-unit 7 travels back to the blade unit 4.

By the wire-drive 3, the wire K is now moved at high speed on the conveyor-belt 12 through the cutting unit 4. This operation is known as "shooting-in" of the wire K. Shooting-in takes place in such manner that the desired wire-length of the wire K is attained, the conveyor belt 12 ensuring that the wire K always remains stretched.

After transport of the desired wire-length, a gripper of the swivel-unit 8 grasps the wire K. The wire K is then separated, and the trailing wire-end stripped of insulation. Simultaneously, on the swivel-unit 7, the same procedure begins again with the next piece of wire. The trailing wire-end is now brought by the swivel-unit 8 to the processing module 6. After fining of the trailing wire-end, the wire K is, for example, laid in a tray, which serves as wire-deposit 13.

Shown in FIG. 1B is the situation according to the prior art during shooting-in of the wire K. The wire guide-tube 11 is stretched, the wire-gripper 7.1 is opened, and the guide-sleeve 10 is positioned in such manner that it cannot collide with the wire-stripping blades 14 when the cutting unit 4 closes. This situation results in the required total length of the guide-pipe 11, A guide-pipe 11 with the correspondingly defined total length is fastened to two fastening points 11.1, 11.2 which are separated by a distance.

Known from patent application EP 1548903 A1 is a corresponding wire-processing machine with an exchangeable guide-tube and a flexible guide-pipe.

Apparatuses are known, see for example U.S. 2001/025870 A1, that contain wire-drives and nozzle arrangements through which wires can be pushed. The apparatus according to U.S. 2001/025870 contains no wire-gripper. The nozzle arrangement has a so-called intermediate nozzle, which contains a stationary and a movable nozzle. The movable nozzle is movable in axial direction by a drive-bar of a cylinder mechanism. The movable nozzle can thereby be transposed from a guiding position into a non-guiding position. In the non-guiding position, this movable nozzle is not connected with another nozzle of the nozzle arrangement. The apparatus according to U.S. 2001/025870 contains no wire-pipe and no wire-gripper. The nozzle arrangement with movable nozzle serves exclusively to bridge a gap between the vertically movable wire-guide of the wire-changer and the wire arrangement while the wire is being changed. During insulation-stripping, or in the swiveled-out state, the nozzle arrangement is inactive.

An apparatus according to U.S. Pat. No. 4,663,822 has a telescopic tube to bring wires safely through opened blades of a separating and insulation-stripping unit during advancement. The telescopic tube can be shortened or lengthened, it is, however, not connected with a guide-pipe. A swivel-unit is completely absent.

Known from patent application FR 2691016 A1 is a wire-handling machine which contains a guide-pipe which can be moved by a swivel-unit. While the wire is being inserted, air is applied to the guide-pipe from the side. The wire-handling machine has no length-compensating unit, At least some prior art devices have the disadvantage that, for example, when shooting-in the wire, contact occurs between the leading wire-end and the blades of the cutting unit. Depending on the processing step, the wire-overhang at the wire-end is either too short or too long.

SUMMARY

In at least some embodiments disclosed herein, the wire apparatus, or a wire-processing apparatus respectively, is equipped with a corresponding length-compensating unit, which offers an array of advantages. The length-compensating unit can provide passively or actively, depending on the embodiment, a different effective length of the guide-pipe.

This type of wire-guide can also be used in other machine concepts, for example in wire-processing apparatuses that have a transfer system instead of the second swivel-unit.

BRIEF DESCRIPTION OF THE DRAWINGS

The present disclosure is explained in more detail by reference to the attached figures. Shown are in.

DETAILED DESCRIPTION

Certain aspects of a wire-processing apparatus 1 were already described in connection with FIGS. 1A and 1B. At least some of what was described there can also be applied to one or more of the following embodiments.

Figure 1A:
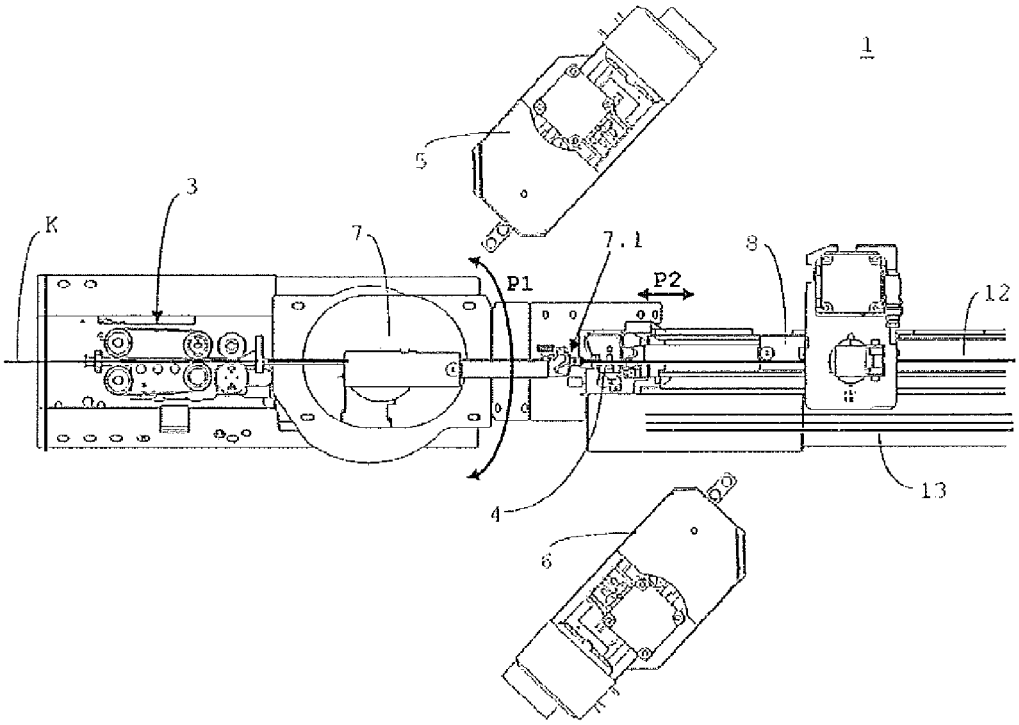
Fig. 1A (Prior art)
FIG. 1A, a plan view of part of a previously known wire-processing machine.
Figure 2:
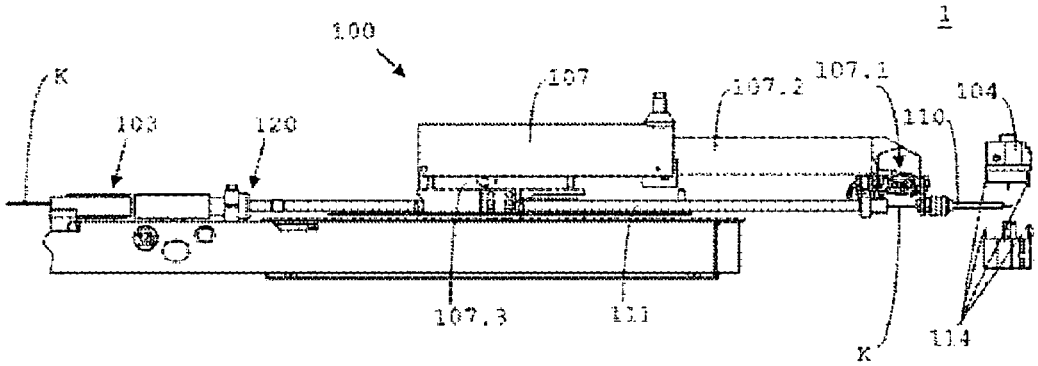
FIG. 2, a side view of an embodiment of a wire-feeding apparatus with length-compensating unit.

FIG. 2 shows a wire-feeding apparatus 100 of a wire-processing machine or apparatus 1. The wire-feeding apparatus 100 contains a wire-advance device 103 which is embodied as belt-drive (not shown in FIG. 2), wherein the wire-advance device 103 feeds a wire K of a swivel-unit 107 with a swivel-arm 107.2 with gripper 107.1. Here, the wire-advance device 103 is also designated as wire-drive 103. The wire-advance device 103 can, for example, be executed similar to the wire-advance device 3 in FIG. 1A. The wire K is guided in a flexible (wire-)guide-pipe 111, the advanced wire-length being measurable, for example, by means of an optional encoder (not shown) of the wire-advance device 103.

The flexible (wire-)guide-pipe 111 is fastened on the entry-side to a length-compensating unit 120 as shown in FIG. 2 and emerges on the exit-side in the area of a gripper 107.1 of the swivel-arm 107.2. On the exit-side, the guide-pipe 111 is joined to the swivel-arm 107.2. That is to say, at the one end, the guide-pipe 111 is joined via the length-compensating unit 120 lengthwise-movably with the wire-processing machine or apparatus 1 and, at the other end, monolithically-movably with the swivel-arm 107.2.

Figure 1B:
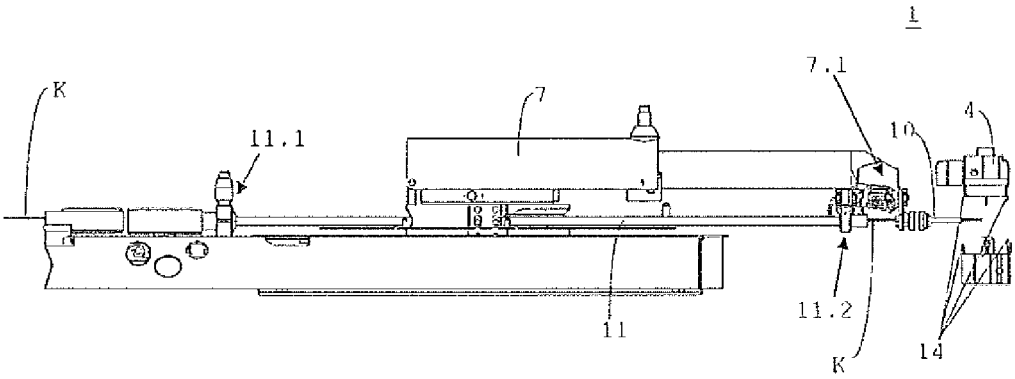
Fig. 1B (Prior art)
FIG. 1B, a side view of part of the previously known wire-processing machine according to FIG. 1A.

By means of one or more drives 107.3, the swivel-arm 107.2 can be set in a swiveling motion (similar to the swivel movement that is symbolized in FIG. 1A with an arrow P1) and/or in a linear motion (similar to the linear movement symbolized in FIG. 1A with an arrow P2). Details of the drive(s) 107.3 and of the swivel-arm 107.2 with gripper 107.1 are explained in, for example, patent application EP 03405094.8. Further aspects of the technical overall construction can also be taken from the patent application EP 1548903 A1 mentioned at the outset.

In FIG. 2, the swivel-arm 107.2 is shown in the zero position (Position II in FIG. 5) or in the lengthwise axis of the wire respectively, in which here, for example, a cutting unit 104 that serves as processing station is arranged, which cuts into and insulation-strips a leading wire-end, wherein the wire-end is held by means of the gripper 107.1 and of a guide-tube 110 which is arranged on the gripper 107.1. The clear diameter of the guide-tube 110 fits onto the external diameter of the wire K.

In at least some embodiments, the wire-feeding apparatus 100 contains a guide-tube 110 as mentioned. The guide-tube 110 contains a passage 110.1 (not visible in the figures) which extends in the longitudinal direction, The guide-tube 110 is arranged in the area of an exit-side end 111.2 of the guide-pipe 111, as shown by reference to an example in FIG. 6, and the passage 110.1 runs coaxial to the guide-pipe 111.

In at least some embodiments, the wire-feed apparatus 100 contains a so-called length-compensator or length-compensating unit 120, as already mentioned, This length-compensating unit 120 possibly sits on the entry-side end of the (wire-) guide-pipe 111. That is to say, in this case the length-compensating unit 120 sits at the end that lies opposite the end at which the said optional guide-tube 110 is deployed. The guide-tube 110, if present, sits on the exit-side end of the (wire-) guide-pipe 111.

In total, the constellation can be so chosen that a wire K can be shot-in from the entry-side E through the passage 127 of the length-compensating unit 120 into the (wire-) guide-pipe 111. The passage 127 of the length-compensating unit 120 and the (wire-) guide-pipe 111 lie mutually coaxial. The optional guide-tube 110 also runs coaxial.

Figure 3A:
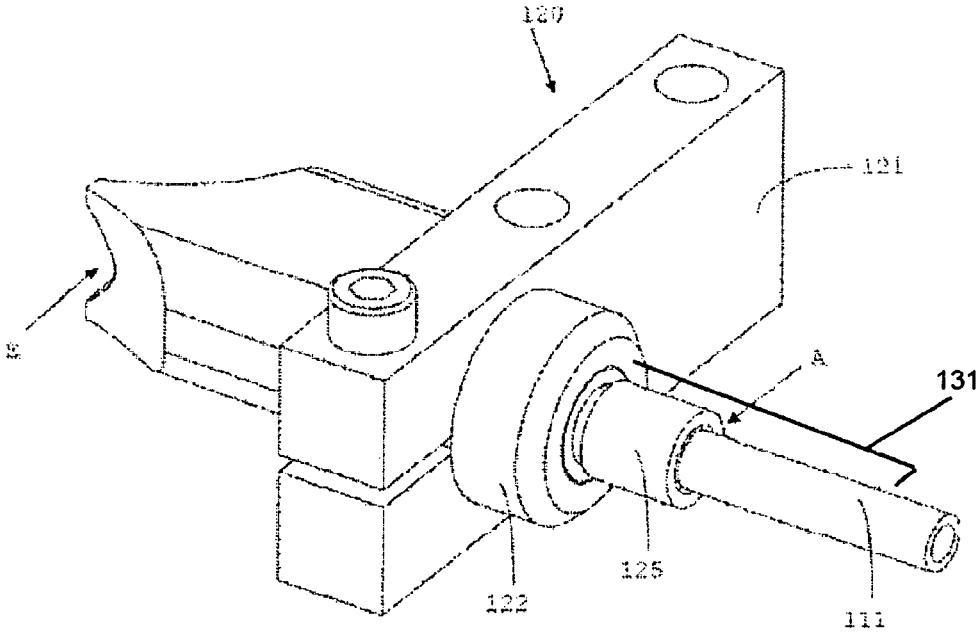
FIG. 3A, a perspective view of an embodiment of a length-compensating unit.
Figure 3B:
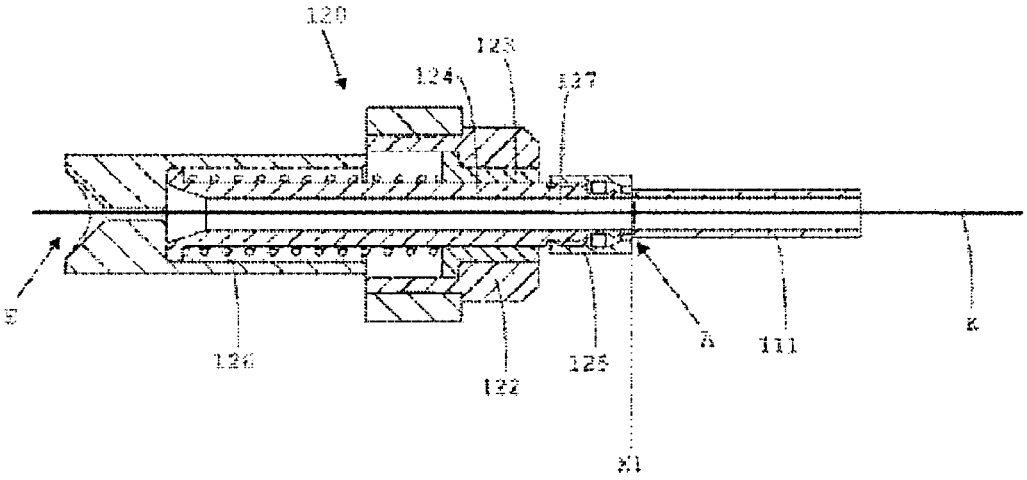
FIG. 3B, a cross-sectional view of the length-compensating unit according to FIG. 3A in retracted (contracted) state.
Figure 3C:
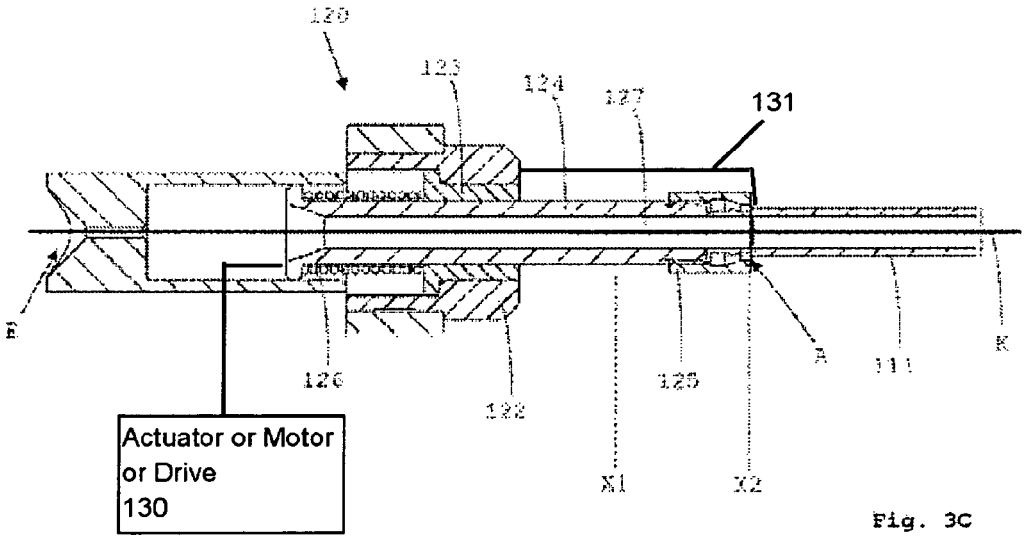
FIG. 3C, a cross-sectional view of the length-compensating unit according to FIG. 3A in extended (expanded) state.

Shown in FIGS. 3A, 3B, and 3C are details of an exemplary embodiment of the length-compensating unit 120.

FIG. 3A shows a three-dimensional view of an embodiment of a length-compensating unit 120. The length-compensating unit 120 preferably contains a (gripping-)holder 121 with a cylindrical holder 122, sitting within which is a bearing bush 123. Inside the bearing bush 123 a guide-seal 124 is mounted movably in such manner that the length-compensating unit 120 can adopt at least two states. The first state is shown in FIG. 3B and is designated as a retracted or collapsed state. In this state, the guide-seal 124 sits further left than in the extended (expanded) state that is shown in FIG. 3C.

In at least some embodiments, the length-compensating unit 120 additionally contains a (lock-)nut 125 to fasten the entry-side end of the guide-pipe 111 to the guide-seal 124.

For this purpose, the end-piece of the guide-seal 124 can have an external thread, which is designed to match the internal thread of the nut 125. The nut 125 and the guide-seal 124 can be designed so that, on tightening of the nut 125, the (wire-)guide-pipe 111 is pushed onto a conical seat of the guide-seal 124 and thereby fastened.

As shown in FIG. 3C, the guide-seal 124 can be mounted in such manner, or the length-compensating unit 120 can be so designed, that it can execute a maximum stroke in the longitudinal direction which results from the distance between the positions X1 and X2.

Through movement/displacement of the guide-seal 124 relative to the stationary part (e.g. the part 122) of the length-compensating unit 120, the (wire-)guide-pipe 111 makes a movement in the direction of transportation of the wire K (in FIGS. 3A, 3B, 3C, to the right).

The guide-seal 124 is hence correspondingly mounted in the bearing bush 123 in lengthwise-movable manner. In some embodiments, the former can be pulled back by an internally or externally located (compression-)spring 126, so as to hold the (wire-) guide-pipe 111 stretched within a certain length-range X1 to X2.

The length-compensating unit 120 has an entry-side E, an exit-side A, and a cylindrical passage 127. The passage 127 extends from the entry-side E to the exit-side A, there being on the exit-side A a transition to the guide-pipe 111, as mentioned, The length-compensating unit 120 can be designed in such manner that shooting-in of the wire K into the passage 127 takes place through the entry-side E and from there into the (wire-) guide-pipe Ill. The passage 127 can have an internal diameter that is somewhat larger than the external diameter of the wire K.

In at least some embodiments, the (wire-)guide-pipe 111 can be fastened to the guide-seal 124 with a lock-nut 125, as described. The (wire-)guide-pipe 111 can, however, also be fastened with other identically acting means.

Besides the embodiments of the length-compensating unit 120 shown in FIGS. 3A-3C, other variants are also possible.

For example, in the length-compensating unit 120, the (compression-)spring 126 can be replaced by another elastic element, for example a pneumatic or hydraulic cylinder. With such a cylinder, the length-compensating function of the length-compensating unit 120 can be programmably turned on and off. In this case, the length-compensating unit 120 would hence be an active length-compensating unit. A pneumatic or hydraulic cylinder or drive 130 is shown in FIG. 3*c* acting on the guide-seal 124.

The length-compensating unit 120 can, for example, also be designed as a motor-actuated programmable length-compensator. In this case, the length-compensating function of the length-compensating unit 120 can be addressed or set in controlled manner, i.e. also in this case, the length-compensating unit 120 is active. A motor or actuator 130 is shown in FIG. 3*c* acting on the guide-seal 124.

The length-compensating unit 120 can also be fitted with a blocking capability (e.g. in the form of engagement points) to enable the length-compensating unit 120 to be temporarily blocked in one or more freely definable positions (depending on the method-step or process-step of the wire-processing). A blocking component 131 is shown in FIGS. 3A and 3C for blocking the guide-seal 124 at the position X2.

These various variants of the length-compensating unit 120 can also be mutually combined. Hence, for example, a passive length-compensating unit 120 according to FIG. 3A can be fitted with a blocking capability, or a solution with spring 126 according to FIG. 3B, 3C can be assisted by a motor-actuated programmable length-compensator, which results in an active solution.

Through deployment of the wire-feed apparatus 100, the following method, for example, of guiding a wire K can be realized. For this purpose, for the forward movement of the wire K, the respective wire-feed apparatus 100 contains a wire-drive 103 and a guide-pipe 111 with an entry-opening and an exit-opening, the wire-drive 103 moving the wire K forward and shooting it into the guide-pipe 111. Before execution of a first processing step of the wire K, an effective length of the guide-pipe 111 is lengthened by the deployment of a length-compensating unit 120. Before execution of a second processing step of the wire K, the effective length of the guide-pipe 111 is shortened by deployment of the length-compensating unit 120. As already explained, the lengthening and/or shortening can be effected passively (e.g. purely mechanically by the action of a spring 126) or actively. The lengthening and/or shortening takes place through interaction of the subassembly, comprising length-compensating unit 120 and guide-pipe 111, with the swivel-arm 107.2 or swivel-unit 107 respectively.

In at least some cases, when lengthening and/or when shortening, a movably borne guide-seal 124 of the length-compensating unit 120 is moved.

Optionally, further guide-tubes 110 with different clear diameters can be stored in a magazine (not shown in FIG. 2) of the apparatus 100. In this case, the guide-tube 110 can be exchanged manually or by machine.

Depending on the embodiment and the foreseen purpose, the length-compensating unit 120 can be arranged on the entry-side or in the entry-side area of the guide-pipe 111. It is, however, also possible to arrange the length-compensating unit 120 as intermediate piece of the guide-pipe 111 or on the exit-side of the guide-pipe 111. If the length-compensating unit 120 is deployed as intermediate piece of the guide-pipe 111, the guide-pipe 111 contains two parts or sections, which are interrupted by the length-compensating unit 120.

Through deployment of the length-compensating unit 120, partial areas of the processing or handling method, or of the guiding of the wire K, can be executed in more controlled manner.

With shooting-in of the wire K, the following advantages result. Different from the existing method shown in FIGS. 1A and 1B, when shooting-in starts, the guide-tube 110 can be situated inside the cutting unit 104, as shown in FIG. 1 That is to say, the exit-side end of the guide-tube 110 penetrates far into the intermediate space of the cutting unit 104. The wire-overhang in this state can be correspondingly shorter, and at least some process steps that are executed by the cutting unit 104 can be executed more precisely.

In at least some cases, for example in the case of wires K with small cross-section, the danger of a collision of the bending wire with elements (for example, the blades 114) of the cutting unit 104 thereby reduces.

Figure 4:
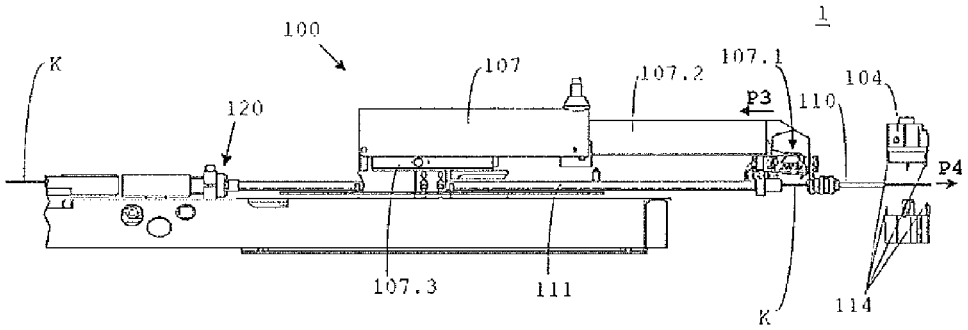
FIG. 4, a side view of a part of a wire-processing apparatus with length-compensating unit.

To further optimize the chronological sequence of events when processing a wire K, the guide-tube 110 can be moved back already before conclusion of the shooting-in (i.e. here in the direction P3), as shown in FIG. 4. In some cases, this backwards movement P3 of the guide-tube 110 can begin as soon as the wire-point (i.e. the leading wire-end) is situated over the conveyor belt (reference number 12 in FIG. 1B) and hence there is no further danger of the wire K colliding with elements (e.g. the blades 114) of the blade unit 104.

In all further processing steps that are executed with closed wire-gripper 107.1 (i.e. with a wire-gripper 107.1 whose gripping jaws 107.4 are closed), and in which the guide-tube 110 moves backwards in the direction of the wire-drive 103, the guide-pipe 111 must bend together with the wire K, since otherwise the wire K will be compressed by the wire-drive 103. This is typically the case during the withdrawal movement of the wire-stripping operation. Wire-stripping takes place through blades 114 (possibly V-shaped wire-stripping blades are deployed) of the cutting unit 104 being presented in the direction of the wire K and penetrating the insulation of the wire K. The wire K, along with the guide-tube 110, is then moved a short distance to the left, to remove a separated piece of the insulation, a bending of the guide-pipe 111 resulting automatically when the shortest length of the length-compensating unit 120 (e.g. the state shown in FIG. 3B) is attained, or when the length-compensating unit 120 in one of the mentioned alternative embodiments becomes blocked.

The said backwards movement of the wire K along with the guide-tube 110 is optional but offers advantages that depend on the situation.

In some cases, compression of the wire K during the withdrawal movement when insulation-stripping can also be prevented by the wire-drive 103 moving the wire K backwards. However, under certain circumstances, this can be disadvantageous for the accuracy of the length, and can unnecessarily lengthen the processing time.

In a further embodiment, a reduction of the wire-overhang takes place on swiveling-back of the wire K from a processing position into the wire-advance position. In the processing position, for example the leading wire-end of the wire K has been processed by a processing station 5, as shown in FIG. 1A, or by a processing station 105, as shown in FIG. 5.

Figure 5:
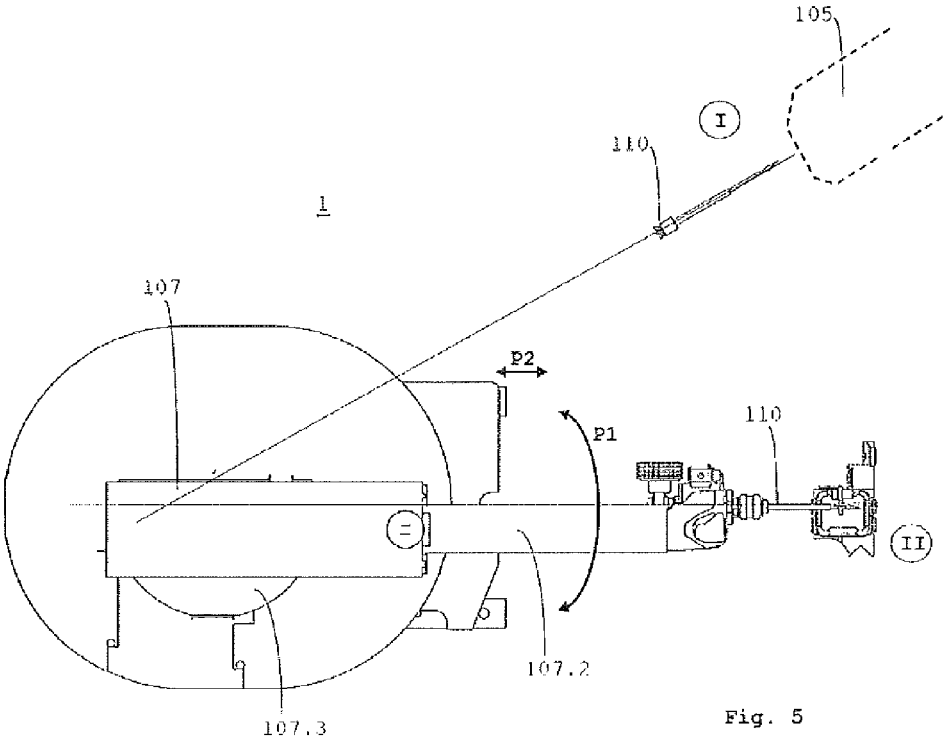
FIG. 5, a plan view of a part of a corresponding wire-processing apparatus.

The principle of reducing the wire-overhang on swiveling-back is shown diagrammatically in FIG. 5. In Position 1, the leading wire-end is situated in the area of a processing station 105. Here, the wire-end projects further out of the guide-tube 110 (i.e. the wire-overhang is greater) than in Position H. That is to say, through the action of the length-compensating unit 120, on transition from Position 1 into Position Il the wire K is slightly pulled back. Generally, the maximum stroke that is possible here is determined by the design of the length-compensating unit 120 and the movement of the gripper 107.1 or of the swivel-arm 107.2.

In another embodiment, during the said swiveling-back from the processing position to the wire-advance position, the length-compensating unit 120 offers the possibility of passively or actively (depending on the embodiment) reducing the wire-overhang. This can be achieved, for example, by the swivel-unit 107 continuously extending the swivel-arm 107.2 while swiveling back.

Figure 6:
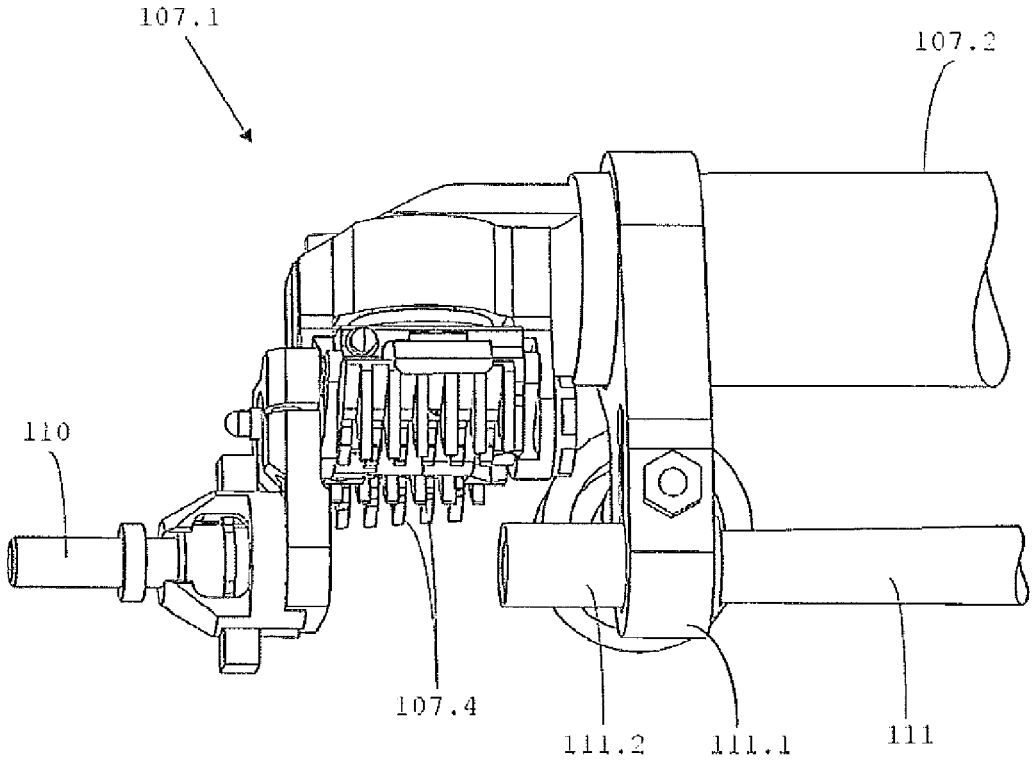
FIG. 6, a three-dimensional view of an embodiment of a swivel-arm with gripper, guide-pipe, and guide-tube of a wire-processing apparatus.

In FIG. 6 a three-dimensional view of the front part of an exemplary embodiment of a swivel-arm 107.2 with gripper 107.1, guide-pipe 111, and guide-tube 110 is shown. The guide-pipe 111 is fastened with the correspondingly defined total length to a fastening point 111.1 on the swivel-arm 107.2, as shown in FIG. 6. In the area of the gripper 107.1, the guide-tube 110 is fastened to the swivel-arm 107.2. The swivel-arm 107.2 with gripper 107.1 and guide-tube 110 serves, for example, as feeding device for feeding wire-ends of the wire K to a processing station 105. The gripper 107.1 is shown with opened gripper-jaws 107.4. To grip the wire K, which is not shown in FIG. 6, the gripper 107.1 is lowered and the gripper-jaws 107.4 are closed.

According to at least some embodiments, the length-compensating unit 120 changes the effective length of the guide-pipe 111 uninterruptedly according to the linear and/or swiveling movement of the swivel-unit.

In at least some embodiments, the lengthening and/or shortening of the effective length of the guide-pipe 111 results from an interaction between the swivel-arm 107.2 and the guide-pipe 111 with the length-compensating unit 120. A swiveling or linear movement P1, P2 (see, for example, FIG. 5) effects a change in length of the guide-pipe 111 along with the length-compensating unit 120, the effective length of the guide-pipe 111 changing through deployment of the length-compensating unit 120.

By lengthening and/or shortening the effective length of the guide-pipe 111, possibly on the exit-side on the guide-pipe 111 the wire K or the wire-end of the wire K can be controlled or positioned better and more accurately. Hence, for example, the wire-overhang can be optimally specified.

Some embodiments can also use a swivel-unit 107, with a swivel-arm 107.2 and a wire-gripping apparatus, instead of the gripper 107.1. For this reason, the term "wire-gripping apparatus" is sometimes used, since this term describes not only grippers but also other means that act similarly.

When crimping, or particularly when fitting seals, the wire-overhang, given by the respective processing station(s), should normally be greater than the wire-overhang given by the improved shooting-in. It is sometimes advantageous to reduce the wire-overhang during swiveling-back. Oscillation of the free wire-end can thereby be reduced and swiveling can be executed faster.

Through deployment of a length-compensating unit 120, a variable wire-overhang can thereby be actively or passively specified depending on the situation.

In general, the length-compensating unit 120 can mean that the wire-overhang can be varied for the individual process steps without it being necessary for the wire K to be capable of being moved backwards or forwards by the wire-drive 103.

This feature can be deployed when shooting-in and/or separating and/or insulation-stripping, the wire-overhang resulting in each case from the distance of the guide-tube 101 from the cutting blade of the cutting unit 104.

In at least some embodiments of the new method, the wire-overhang can be selected smaller, and also suitable for the processes on the processing modules.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. A wire-processing apparatus, comprising:

a wire-feeding apparatus, the wire-feeding apparatus comprising a wire drive and a flexible guide pipe, the flexible guide pipe comprising an entry opening and an exit opening, the wire drive and the guide pipe being arranged such that the guide pipe can receive a wire from the wire drive through the entry opening;

a length-compensating unit fastened to the guide pipe; and a swivel unit, the swivel unit comprising a drive and a wire-gripping apparatus, the wire-gripping apparatus being arranged on a swivel arm, an exit side of the guide pipe being fastened to the swivel arm, the wire drive being configured to receive the wire through the guide pipe, the wire-gripping apparatus being configured to hold the wire, the drive being configured to move the swivel arm in a swiveling movement or linear movement, the swiveling movement or linear movement changing the length-compensating unit from a first state to a second state, an effective length of the guide pipe changing as a result of the length-compensating unit changing from the first state to the second state.

2. The wire-processing apparatus of claim 1, the length-compensating unit comprising a movable guide seal fastened to the entry opening of the guide pipe.

3. The wire-processing apparatus of claim 1, the length-compensating unit comprising an entry side, an exit side and a cylindrical passage, the cylindrical passage extending from the entry side of the length-compensating unit to the exit side of the length-compensating unit, the exit side of the length-compensating unit comprising a transition to the guide pipe.

4. The wire-processing apparatus of claim 1, the length-compensating unit comprising a spring.

5. The wire-processing apparatus of claim 4, the spring being a compression spring for changing the length-compensating unit to the second state.

6. The wire-processing apparatus of claim 1, the length-compensating unit comprising an actuator or motor, the actuator or the motor being configured to move the length-compensating unit between the first state and the second state.

7. The wire-processing apparatus of claim 1, the length-compensating unit comprising a hydraulic drive or a pneumatic drive, the hydraulic drive or the pneumatic drive being configured to move the length-compensating unit between the first state and the second state.

8. The wire-processing apparatus of claim 1, the length-compensating unit comprising a blocking component.

9. The wire-processing apparatus of claim 1, further comprising a guide tube, the guide tube being arranged near the exit side of the guide pipe and being arranged coaxially with the guide pipe, the guide tube comprising a passage, a wire-gripping space being positioned between the guide tube and the exit side of the guide pipe.

* * * * *